United States Patent [19]

Takao et al.

[11] Patent Number: 4,469,074

[45] Date of Patent: Sep. 4, 1984

[54] ELECTRONIC CONTROL FOR INTERNAL COMBUSTION ENGINE

[75] Inventors: Mitsunori Takao, Kariya; Masumi Kinugawa, Okazaki, both of Japan

[73] Assignee: Nippondenso Co., Ltd., Kariya, Japan

[21] Appl. No.: 396,681

[22] Filed: Jul. 9, 1982

[30] Foreign Application Priority Data

Jul. 13, 1981 [JP] Japan ..... 56-109162

[51] Int. Cl.[3] ..... F02M 51/00

[52] U.S. Cl. ..... 123/492; 123/480

[58] Field of Search ..... 123/480, 492, 493, 478

[56] References Cited

U.S. PATENT DOCUMENTS

| | | | |
|---|---|---|---|
| 4,257,377 | 3/1981 | Kinugawa et al. | 123/480 |
| 4,356,803 | 11/1982 | Miyagi | 123/492 |
| 4,359,993 | 11/1982 | Carlson | 123/492 |
| 4,366,541 | 12/1982 | Mouri et al. | 123/480 |
| 4,388,906 | 6/1983 | Sugiyama et al. | 123/492 |

FOREIGN PATENT DOCUMENTS 130734 10/1979 Japan ..... 123/480

*Primary Examiner*—Parshotam S. Lall

*Attorney, Agent, or Firm*—Cushman, Darby & Cushman

[57] ABSTRACT

In an electronic digital control system for engine, a throttle position is sensed at predetermined time intervals to detect a variation thereof from the previous time to the present time, and, after modifying the detected variation by a correction coefficient related to a cooling water temperature to obtain the modified variation, the previous value of a fuel injection amount correction factor computed at the time of previous computation is added to the value of the modified variation to compute the sum. Then, a predetermined subtraction constant is subtracted from the sum to compute the difference therebetween, thereby obtaining the new data of the fuel injection amount correction factor, and this new factor is used to correct the basic fuel amount computed separately on the basis of the operating condition of the engine.

8 Claims, 8 Drawing Figures

ELECTRONIC CONTROL FOR INTERNAL COMBUSTION ENGINE

BACKGROUND OF THE INVENTION

This invention relates to an electronic control for an internal combustion engine, and more particularly to a method and apparatus for controlling the amount of fuel in a transient stage of operation of the engine of the type comprising an electronic-control fuel system such as an electronic fuel injection system or an electronic carburetor system.

The amount of fuel required in a transient stage of operation of the engine differs from that required in the steady operating condition of the engine. A control method is known which is applied to the control of the engine for the purpose of attaining optimized control of the amount of fuel injection in a transient stage of operation of the engine. According to this prior art control method, the intake pressure or the position of the throttle valve is sensed at predetermined time intervals to detect a variation thereof in the time interval, and, when the value of the detected variation becomes larger than a predetermined value, a fuel injection increase/decrease factor is obtained which is predetermined with respect to the engine cooling water temperature or which is predetermined with respect to the engine cooling water temperature and the intake manifold pressure (or the throttle position). Then, the value of the fuel injection increase-decrease factor thus obtained is used to correct the basic amount of fuel injection determined primarily by the rotation speed of the engine and the intake manifold pressure, thereby controlling the amount of fuel injection in a transient stage of operation of the engine.

In the prior art control method, the variation of the intake pressure or throttle position is generally detected at relatively long time intervals of, for example, several ten msec corresponding to the fuel injection time intervals. Therefore, when the prior art control method, in which the above variation is detected at the time intervals of several ten msec, is resorted to, the desired correction of the fuel injection meeting the variation of the amount of intake air supplied to the engine cannot be successfully attained in the case of, for example, abrupt acceleration in which the variation is completed within a short period of 2 msec to 30 msec. This is because, in such a case, the detected or computed rate of variation (the differential value) of the intake pressure or throttle position is smaller than the actual rate of variation of the variable.

Therefore, the prior art control method has been defective in that, with such a manner of controlling the amount of fuel injection in a transient stage of the engine operation, backfire of the engine occurs or a response speed is quite low when the temperature of engine cooling water is low.

The prior art control method has also been defective in that, when a micro-computer is used for the programmed control of the amount of fuel injection, a map is required, hence, many program words are required.

SUMMARY OF THE INVENTION

With a view to obviate the defects of the prior art control method pointed out above, it is a primary object of the present invention to provide an improved method and apparatus for controlling an internal combustion engine, which ensures smooth operation of the engine even when the temperature of engine cooling water is low in a transient stage of operation of the engine, and which does not require so many program words for the programmed control.

According to the method and apparatus of the present invention, adapted for the control of the amount of fuel supply in a transient stage of the engine operation, the throttle position or the intake manifold pressure, which is the control variable indicative of the loaded condition of the engine, is sensed at predetermined time intervals to detect a variation thereof from the previous time to the present time, and the value of a fuel supply amount correction factor computed at the previous time of computation is added to the variation detected at the present time. Then, a predetermined subtraction constant peculiar to the operating performance and characteristic of the engine is subtracted from the sum thus obtained to compute the new value of the fuel supply amount correction factor. This new value of the fuel supply amount correction factor is used to correct the basic fuel supply amount computed separately on the basis of the engine rotation speed and the intake manifold pressure indicative of the operating condition of the engine.

In the present invention, the variation of the throttle position or intake manifold pressure indicative of the loaded condition of the engine is detected after the predetermined period from the previous time, and the fuel supply amount correction factor computed at the time of previous computation is added to the detected variation, as described above. Therefore, the time interval for sensing the variable can be shortened to about several msec, so that the fuel supply amount can be corrected to meet the actual rate of variation of the variable. Further, the continuity of control can be maintained without causing any abrupt change (increase or decrease) in the fuel supply amount. Furthermore, by subtracting, from the sum, the predetermined subtraction constant peculiar to the operating performance and characteristic of the engine, it is possible to further alleviate the adverse effect due to an abrupt change of the throttle position or intake manifold pressure indicative of the loaded condition of the engine.

Furthermore, before the fuel supply amount correction factor computed at the time of previous computation is added to the detected variation of the throttle position or intake manifold pressure, the detected variation is preferably modified on the basis of the sensed cooling water temperature, intake air temperature and/or atmospheric pressure which are the variables indicative of the condition of the operating environment of the engine, so that the fuel supply amount can be more accurately controlled.

According to the present invention, therefore, the internal combustion engine can be accurately and reliably controlled in a transient stage of operation or during acceleration or deceleration even when the temperature of engine cooling water is low.

Further, a map is unnecessary when a microcomputer is used for the programmed control of the engine. Therefore, the number of program words required for the programmed control can be greatly decreased compared with that required in the prior art control method.

DESCRIPTION OF THE PREFERRED EMBODIMENT

An embodiment according to the present invention, when applied to a 6-cylinder engine with an electronic fuel injection system of the speed-density type, will now be described in detail with reference to the accompanying drawings.

Figure 1:
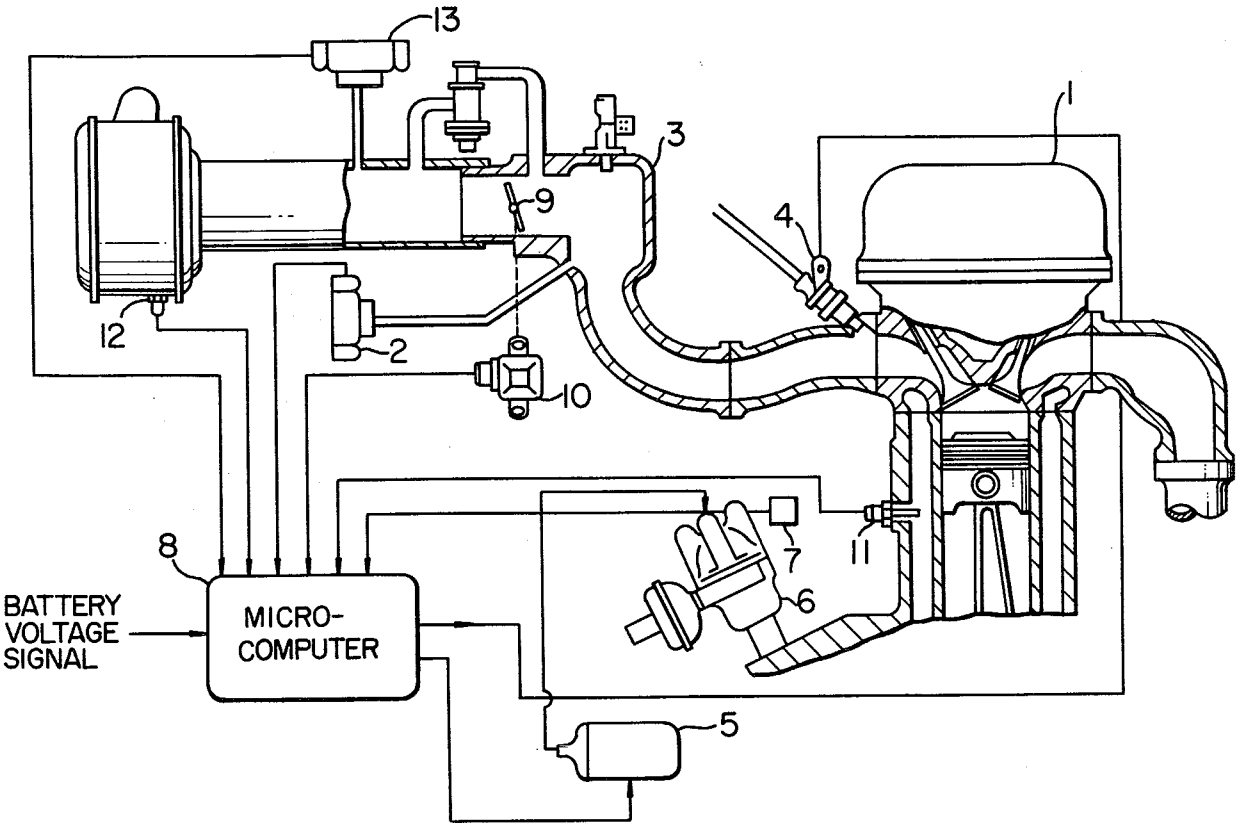
FIG. 1 is a partly sectional, diagrammatic view showing the control system according to an embodiment of the present invention.

FIG. 1 shows the structure of a 6-cylinder engine 1 and its control system. Referring to FIG. 1, a semiconductor type pressure sensor 2 senses the internal pressure of an intake manifold 3. Each electromagnetic fuel injector 4 is disposed adjacent to the intake port of each engine cylinder and fuel at a regulated pressure is supplied to the fuel injector 4. An ignition coil 5 is electrically connected to an ignition distributor 6 which distributes the ignition energy delivered from the ignition coil 5 to the spark plugs. As is commonly known, the distributor 6 makes one revolution while the engine crankshaft makes two revolutions, and a rotation angle sensor 7 sensing the rotation angle of the engine crankshaft is incorporated in the distributor 6.

A throttle position sensor 10 senses the position of a throttle valve 9 throttling intake air. A sensor 11 senses the temperature of engine cooling water to detect the warmed-up state of the engine 1. A sensor 12 senses the temperature of intake air flowing through an air cleaner.

A microcomputer 8 is provided for controlling the operation of the engine 1 by computing the level and application timing of the engine control signals depending on the operating condition of the engine 1. The output signals from the intake pressure sensor 2, rotation angle sensor 7, throttle position sensor 10, cooling water temperature sensor 11 and intake air temperature sensor 12 are applied together with a battery voltage signal to the microcomputer 8, and, on the basis of these input signals, the microcomputer 8 computes the fuel injection amount and computes also the ignition timing. An atmospheric pressure sensor 13 is also provided for sensing the atmospheric pressure.

Figure 2:
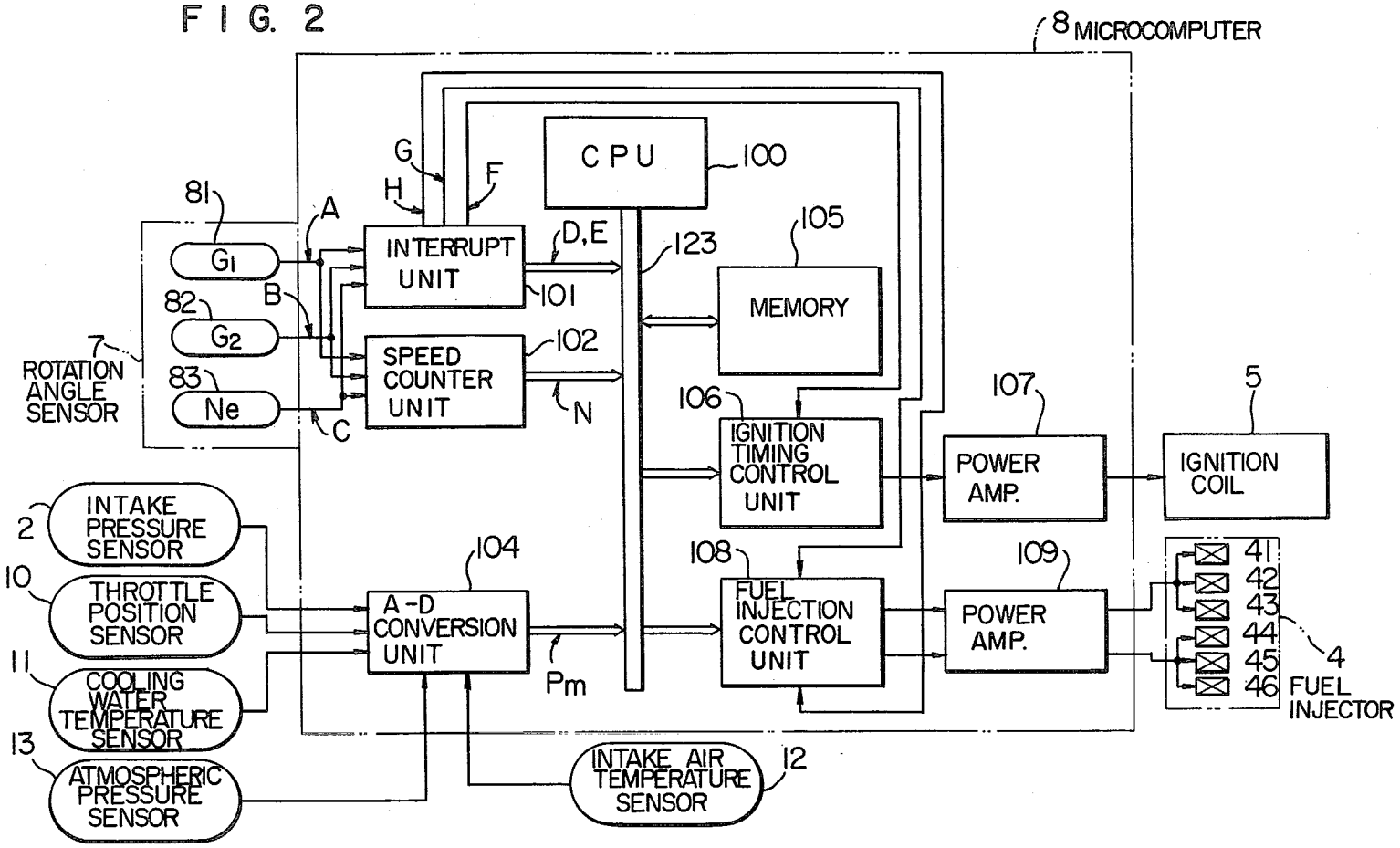
FIG. 2 is a block diagram of the microcomputer and its associated parts shown in FIG. 1.

Referring to FIG. 2, a microprocessor unit (CPU) 100 computes the required amount of fuel injection and the optimum ignition timing in response to the application of an interrupt processing command signal from an interrupt unit 101. On the basis of the rotation angle signal applied from the rotation angle sensor 7 the interrupt unit 101 applies such an interrupt command signal to the microprocessor 100, so that the microprocessor 100 computes the required amount of fuel injection and the ignition timing in response to the application of the command signal. The interrupt unit 101 applies such an information signal by way of a common bus 123. The interrupt unit 101 generates also timing signals F, G and H for controlling the operation starting timing of units 106 and 108 described later. The rotation angle signal is also applied to a speed counter unit 102 which measures the period of a predetermined rotation angle in timed relation with a clock signal of a predetermined frequency so as to compute the engine speed. An A-D conversion unit 104 has the function of making A-D conversion of the analog output signals from the intake pressure sensor 2, intake air temperature sensor 12, throttle position sensor 10, cooling water temperature sensor 11 and atmospheric pressure sensor 13 and applying the resultant digital signals to the microprocessor 100. These units 102 and 104 apply their information output signals to the microprocessor unit 100 by way of the common bus 123.

A memory unit 105 has the function of storing a control pregram prepared for the control of the microprocessor unit 100 and storing the information output signals from the units 101, 102 and 104. The common bus 123 is also used for the information transmission between the memory 105 and the microprocessor 100. An ignition timing unit 106 including a register therein is also connected to the microprocessor 100 by the common bus 123. The microprocessor 100 computes the timing of starting power supply to the ignition coil 5 and the timing of interrupting power supply to the ignition coil 5, hence, the ignition timing, and applies a digital signal indicative of the ignition timing to the counter unit 106. In response to the application of such a signal, the counter unit 106 computes the duration and timing in terms of the rotation angle. A power amplifier 107 amplifies the output signal from this ignition timing control counter unit 106 and supplies its output power to the ignition coil 5 and also to control the timing of interrupting energization of the ignition coil 5, hence, the ignition timing. A fuel injection control unit 108 including a register is also connected to the microprocessor 100 by the common bus 123. This unit 08 includes two down counters having the same function. The microprocessor 100 computes the open duration of the fuel injector 4, hence, the required fuel injection amount, and applies computed digital signals to the unit 108. Each of the down counters converts such a signal into a pulse signal having a pulse width indicative of the open duration of the fuel injector 4. A power amplifier 109 amplifies the pulse signals applied from this unit 108 to supply its output power to the fuel injector 4 through two channels corresponding to the two down counters respectively of the unit 108. It will be seen in FIG. 2 that the fuel injectors 41, 42 and 43 are supplied with the power through one of the channels, and the fuel injectors 44, 45 and 46 are supplied with the power through the other channel.

Figure 3:
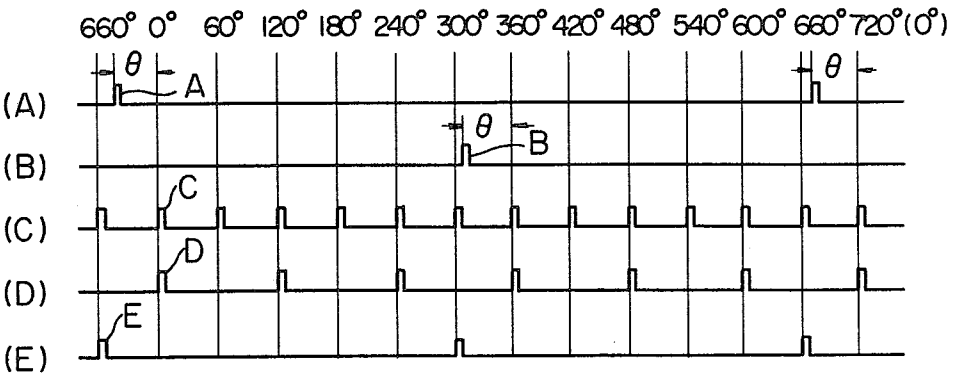
FIG. 3 shows signal waveforms applied from the rotation angle sensor to the microcomputer shown in FIG. 1.

In its practical form, the rotation angle sensor 7 is composed of three sensors 81, 82 and 83 as shown in FIG. 2. The first sensor 81 is so constructed that, while the engine crankshaft makes two revolutions, one angle signal pulse A appears at an angular position earlier by $\theta°$ than the crank angle of O° as shown by the waveform in (A) of FIG. 3. The second sensor 82 is so constructed that, while the engine crankshaft makes two revolutions, one angle signal pulse B appears at an angular position earlier by $\theta°$ than the crank angle of 360° as shown by the waveform in (B) of FIG. 3. The third sensor 83 is so constructed that, while the engine crankshaft makes one revolution, angle signal pulses C, the number of which is equal to the number of the cylinders of the engine 1, appear at equal time intervals as shown by the waveform in (C) of FIG. 3. Thus, in the case of the embodiment of the present invention applied to the 6-cylinder engine, six angle signal pulses C appear at angular intervals of 60° between, for example, 0° and 360°.

The angle signals (the crankshaft rotation angle signals) from the individual sensors 81, 82 and 83 are applied to the interrupt unit 101, and an interrupt command signal commanding interrupt for the computation of the ignition timing and another interrupt command signal commanding interrupt for the computation of the fuel injection amount are generated from the interrupt unit 101. More precisely, the interrupt unit 101 divides the frequency of the angle signal C from the third sensor 83 by the factor of 2 and generates an interrupt command signal D as shown in (D) of FIG. 3 immediately after the angle signal A has been generated from the first rotation angle sensor 81. Six pulses of this interrupt command signal D appear while the crankshaft makes two revolutions. That is, the number of these signal pulses D appearing while the crankshaft makes two revolutions is equal to the number of the cylinders of the engine 1. Thus, these signal pulses D appear at angular internals of 120° in terms of the crank angle of the crankshaft of the engine 1 having six cylinders, and such a signal D is applied from the interrupt unit 101 to the microprocessor 100 to command interrupt for the computation of the ignition timing. Further, the interrupt unit 101 divides the frequency of the angle signal C from the third sensor 83 by the factor of 6 and generates another interrupt command signal E as shown in (E) of FIG. 3. It will be seen in (E) of FIG. 3 that one pulse of the interrupt command signal E appears at the position of the sixth pulse of the angle signal C after the appearance of the angle signal pulse A from the first sensor 81, that is, at the crank angle of 300°, and the next pulse appears at the position of the sixth pulse of the angle signal C after the appearance of the angle signal pulse B from the second sensor 82, that is, after the crankshaft rotates through 360° (one revolution) from the crank angle of 300°. Such an interrupt command signal E is applied from the interrupt command unit 101 to the microprocessor unit 100 to command interrupt for the computation of the required fuel injection amount.

Figure 4:
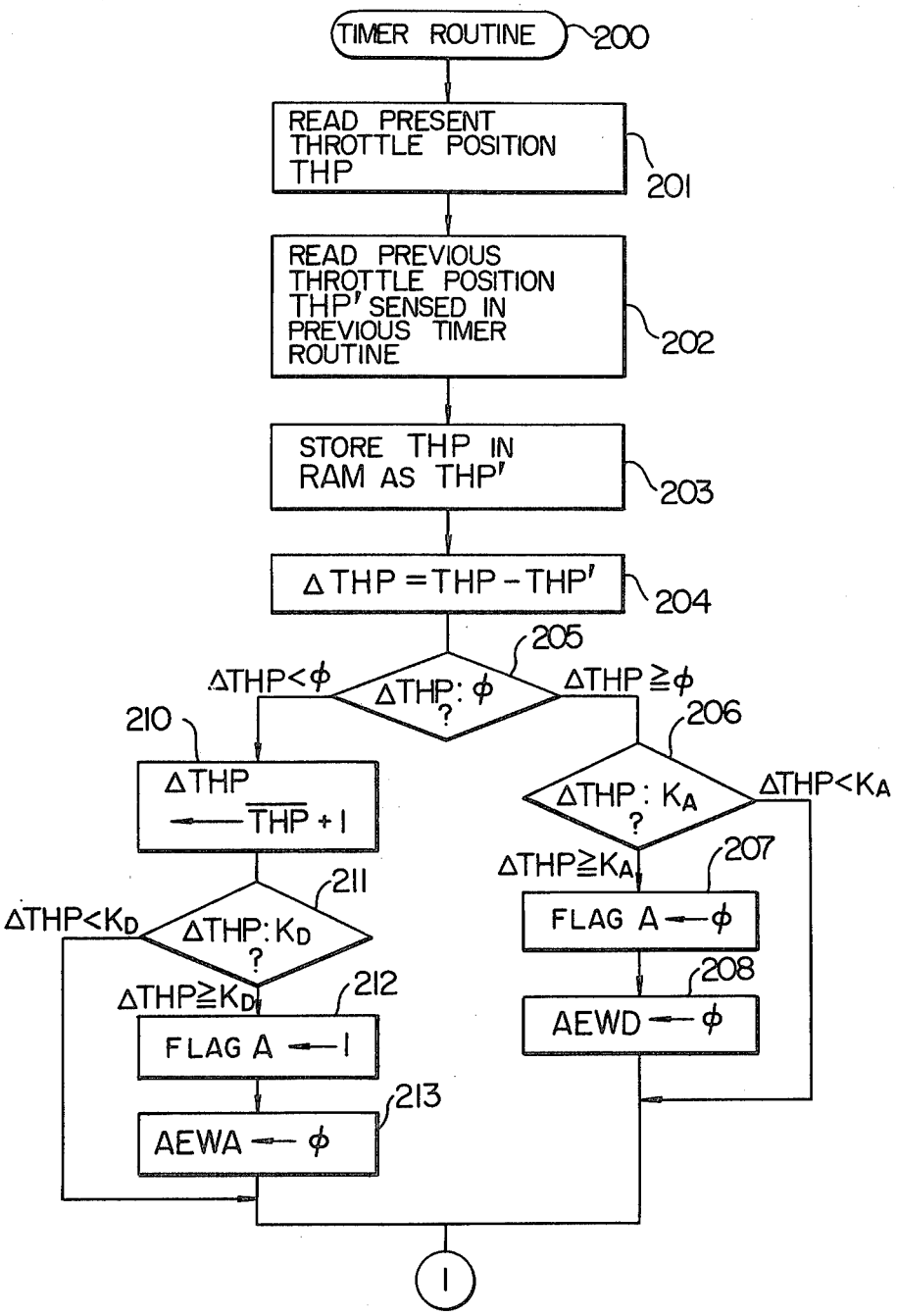
FIGS. 4 and 5 are a logical flow chart illustrating the manner of control according to the present invention.
Figure 5:
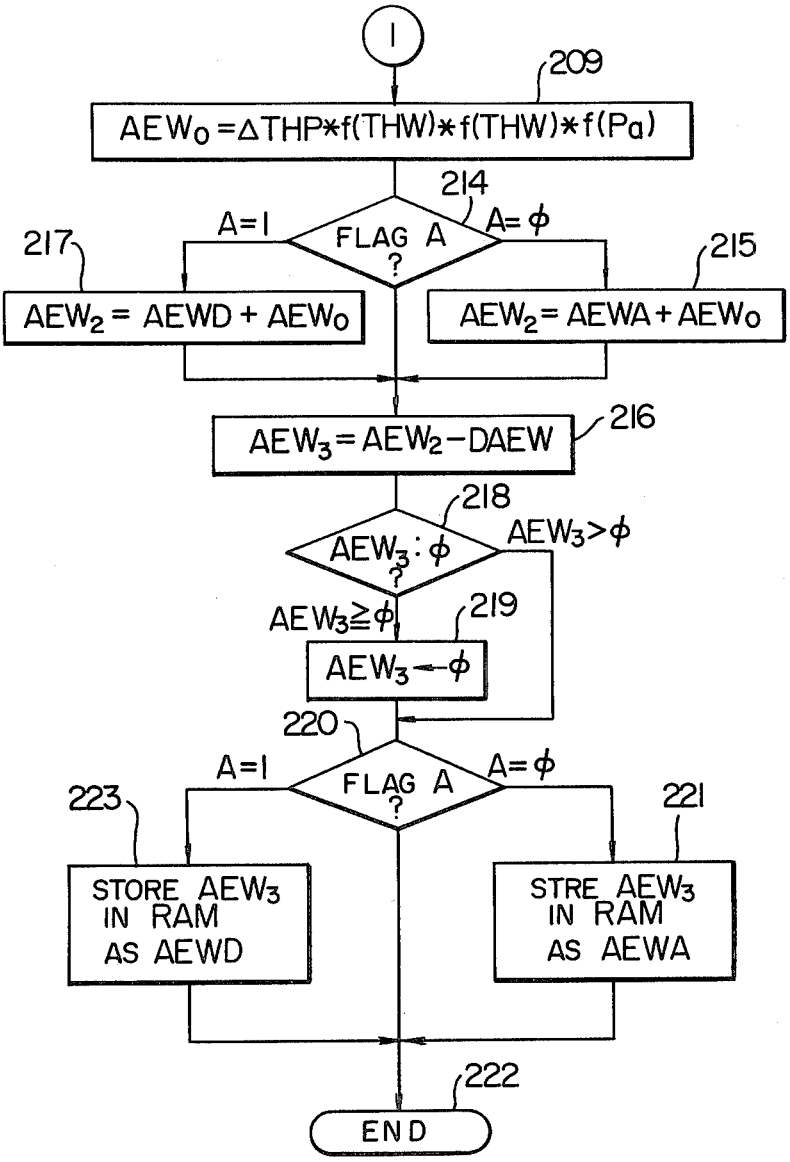

The control of the fuel injection amount by the microcomputer 8 shown in FIG. 2 will be described with reference to a logical flow chart shown in FIGS. 4 and 5. The control program stored in the memory 105 is prepared so that the CPU 100 can execute a timer routine 200 at predetermined time intervals even when the main routine is being run. In step 201 of the timer routine 200, the A-D converted data THP of the newest throttle position is supplied from a RAM in the memory 105 to the CPU 100, and, in step 202, the data THP' of the previous throttle position sensed and processed in the previous timer routine 200 is supplied from the RAM to the CPU 100. In step 203, the throttle position data THP is stored as THP' in the RAM, and, in step 204, the previous throttle position data THP' is subtracted in the CPU 100 from the newest throttle position data THP to find a variation ΔTHP of the throttle position in the predetermined period of time.

In step 205, judgment is made as to whether the variation ΔTHP is positive (which is indicative of acceleration) or negative (which is indicative of deceleration). When the result of judgment in step 205 proves that ΔTHP is positive or zero, the step 205 is followed by step 206 in which the variation ΔTHP is compared with a predetermined constant $K_A$ which is peculiar to the engine when the engine is in its acceleration mode. When the result of comparison in step 206 proves that ΔTHP is smaller than the constant $K_A$, the step 206 is followed by step 209. When, on the other hand, the result of comparison in step 206 proves that ΔTHP is larger than or equal to the constant $K_A$, the step 206 is followed by step 207 in which the logical flow control flag A is set at "0". Then, in step 208, the deceleration-mode fuel injection mount correction factor AEWD computed in the previous timer routine 200 and stored in the RAM is set at zero, and the step 208 is followed by step 209. When, on the other hand, the result of judgment in step 205 proves that ΔTHP is negative, the 2's complement of ΔTHP is computed in step 210, and, in step 211, ΔTHP is compared in the CPU 100 with a predetermined constant $K_D$ which is peculiar to the engine when the engine is in its deceleration mode. When the result of comparison in step 211 proves that ΔTHP is smaller than the constant $K_D$, the step 211 is followed by step 209. On the other hand, when the result of comparison in step 211 proves that ΔTHP is larger than or equal to the constant $K_D$, the step 211 is followed by step 212 in which the logical flow control flag A is set at "1". Then, in step 213, the acceleration-mode fuel injection amount correction factor AEWA computed in the previous timer routine 200 and stored in the RAM is set at zero, and the step 213 is followed by step 209.

Figure 6:
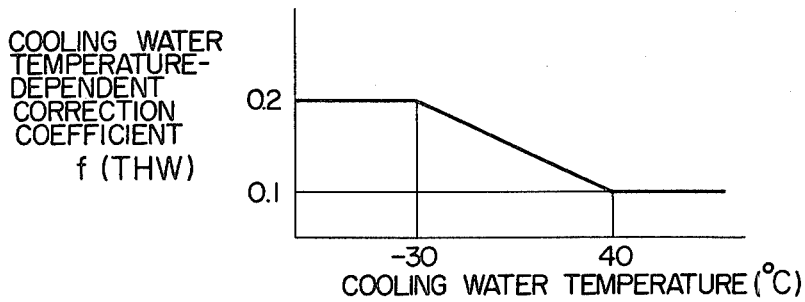
FIG. 6 is a graph showing the relation between the temperature of engine cooling water and the cooling water temperature-dependent correction coefficient.
Figure 7:
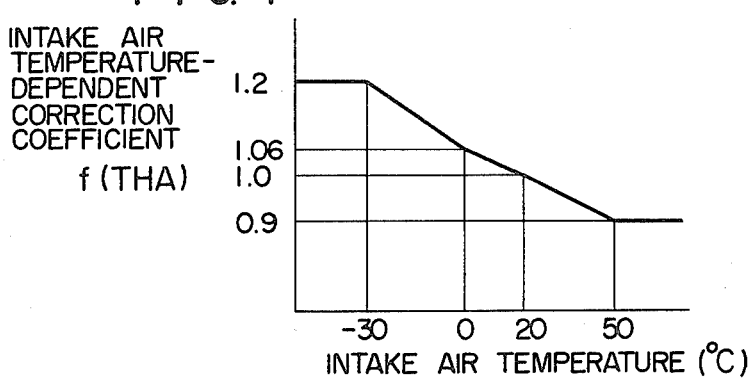
FIG. 7 is a graph showing the relation between the temperature of intake air and the intake air temperature-dependent correction coefficient.
Figure 8:
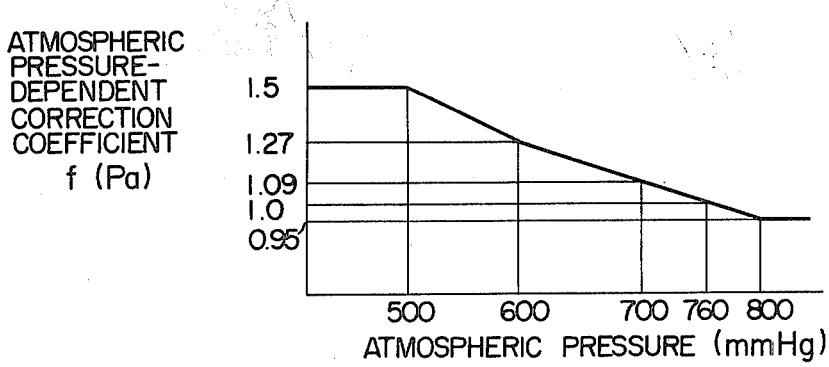
FIG. 8 is a graph showing the relation between the atmospheric pressure and the atmospheric pressure-dependent correction coefficient.

In step 209, the variation ΔTHP is corrected for all of the sensed cooling water temperature THW, sensed intake air temperature THA and sensed atmospheric pressure Pa to compute the value of $AEW_0$ which represents the modified value of ΔTHP. More precisely, the value of $AEW_0$ is computed by multiplying the detected throttle position variation ΔTHP by a cooling water temperature-dependent correction coefficient $f$(THW) as shown in FIG. 6, an intake air temperature-dependent correction coefficient $f$(THA) as shown in FIG. 7 and an atmospheric pressure-dependent correction coefficient $f$(Pa) as shown in FIG. 8. Then, the step 209 is followed by step 214 in which a judgment is made as to whether the logical flow control flag A is "0" or "1". When the result of judgment in step 214 proves that the logical flow control flag A is "0", the step 214 is followed by step 215 in which the value of AEWA stored in the RAM and the value of $AEW_0$ computed in step 209 are added to compute the sum $AEW_2 = AEWA + AEW_0$, and the step 215 is followed by step 216. When on the other hand, the result of judgment in step 214 proves that the logical flow control flag A is "1", the step 214 is followed by step 217 in which the value of AEWD stored in the RAM and the value of $AEW_0$ computed in step 209 are added to compute the sum $AEW_2 = AEWD + AEW_0$, and the step 217 is followed by step 216. It will thus be seen that, in steps 215 and 216, the previously computed values of the fuel injection amount correction factors AEWA and AEWD are added to the value of the detected throttle position variation ΔTHP corrected for all of the sensed cooling water temperature, sensed intake air temperature and sensed atmospheric pressure when the engine 1 is in its acceleration mode and deceleration mode respectively, so as to maintain the continuity of control of the fuel injection amount thereby ensuring the desired smooth and accurate control.

In step 216, the predetermined subtraction constant DAEW peculiar to the operation performance and characteristic of the engine 1 is substracted from the value of $AEW_2$ to compute the difference $AEW_3 = AEW_2 - DAEW$. It will be seen that this subtraction is effective for further alleviating the adverse effect due to an abrupt change of the throttle position in a transient stage of operation of the engine.

Then, in step 218, judgment is made as to whether the sign of the value of $AEW_3$ computed in step 216 is positive or negative. When the result of judgment in step 218 proves that the value of $AEW_3$ is negative or zero, the value of $AEW_3$ is set at zero in step 219, and the step 219 is followed by step 220. Thus, when the result of judgment in step 218 proves that the value of $AEW_3$ is negative or zero, it means that any correction for the fuel injection amount is unnecessary.

In step 220, judgment is made as to whether the logical flow control flag A is "0" or "1". When the result of judgment in step 220 proves that the logical flow control flag A is "0", the step 220 is followed by step 221. In step 221, the value of $AEW_3$ is stored in the RAM as the presently computed value of the fuel injection amount correction factor (in the acceleration mode) AEWA, and the step 221 is followed by step 222 to complete the timer routine 200. On the other hand, when the result of judgment in step 220 proves that the logical flow control flag A is "1", the step 220 is followed by step 223. In step 223, the value of $AEW_3$ is stored in the RAM as the presently computed value of the fuel injection amount correction factor (in the deceleration mode) AEWD, and the step 223 is followed by step 222 to complete the timer routine 200.

In a fuel injection amount computation routine (not shown), the basic fuel injection amount $T_P$ determined on the basis of the engine rotation speed and intake manifold pressure is corrected to increase or decrease depending on the status of the logical flow control flag A. More precisely, the basic fuel injection amount $T_P$ is corrected to be $T_P \times (1 + AEWA)$ when the control flag A is "0", and to be $T_P \times (1 - AEWD)$ when the control flag A is "1".

FIGS. 6, 7 and 8 show the cooling water temperature-dependent correction coefficient $f$(THW) relative to the cooling water temperature, the intake air temperature-dependent correction coefficient $f$(THA) relative to the intake air temperature, and the atmospheric pressure-dependent correction coefficient $f$(Pa) relative to the atmospheric pressure. These correction coefficients are stored at specified addresses of the ROM region of the memory unit 105 of the microcomputer 8 to be used for the correction of the throttle position variation ΔTHP in the step 209. It will be seen in FIG. 6 that the lower the temperature of engine cooling water, the larger is the value of the correction coefficient $f$(THW) used for correcting the throttle position variation ΔTHP on the basis of the sensed cooling water temperature, so that the temperature dependence of the fuel evaporation rate can be corrected. It will also be seen in FIG. 7 that the lower the intake air temperature, the larger is the value of the correction coefficient $f$(THA) used for correcting the throttle position variation ΔTHP on the basis of the sensed intake air temperature, so that a variation of the density due to an intake air temperature variation which cannot be sensed by sensing the throttle valve opening, can be corrected. It will also be seen in FIG. 8 that the lower the atmospheric pressure, the larger is the value of the correction coefficient $f$(Pa) used for correcting the throttle position variation ΔTHP on the basis of the sensed atmospheric pressure, so that a variation of the density due to an intake air pressure variation which cannot be sensed by sensing the throttle valve opening, can be corrected.

In the aforementioned embodiment of the present invention, the fuel injection amount correction factor variable in a transient stage of operation of the engine is computed by running a timer routine at predetermined time intervals. However, this correction factor may be computed by running such a routine at angular intervals of a predetermined crank angle. Further, this correction factor may also be computed by running such a routine in synchronism with the programmed processing by the microcomputer, instead of running such a routine at the predetermined time intervals corresponding to the periods of A-D conversion of the throttle valve opening and instead of running such a routine at the angular intervals of the predetermined crank angle.

Although the embodiment of the present invention is described with reference to its application to a 6-cylinder internal combustion engine comprising an electronically-controlled fuel injection system of the speed-density type by way of example, it is apparent that the present invention is in no way limited to such a specific application and is equally effectively applicable to any other multicylinder internal combustion engines encluding 4-cylinder and 8-cylinder engines.

Further, although the embodiment of the present invention has been described with reference to the control of an internal combustion engine comprising an electronically-controlled fuel injection system by way of example, it is apparent that the present invention is in no way limited to such a specific control and is also equally effectively applicable to the control of an internal combustion engine with an electronically-controlled carburetor system.

We claim:

1. A method for electronically controlling the amount of fuel supplied to an internal combustion engine comprising the steps of:

sensing at least one of the control variables indicative of the loaded condition of the engine at predetermined time intervals to detect a variation thereof from the previous time to the present time;

determining whether said engine is in an accelerating condition or a deceleration condition by judging the sign of said variation;

adding the previous value of a fuel supply amount correction factor for acceleration computed at the time of previous computation to the detected variation only when the engine is judged in the preceding step as being in the accelerating condition thereby computing the sum;

subtracting a predetermined substraction constant from the sum obtained as a result of the addition in the preceding step to compute the difference therebetween, thereby obtaining the new value of the fuel supply amount correction factor;

using the thus obtained new value of the fuel supply amount correction factor to correct a basic fuel supply amount computed separately on the basis of the operating condition of the engine; and controlling the fuel supply in accordance with a fuel supply control signal representative of the corrected basic fuel supply amount.

2. A method as claimed in claim 1, further comprising the steps of:

clearing the content of said fuel supply amount correction factor for acceleration when the engine is judged in said determining step as being not in the accelerating condition.

3. A method as claimed in claim 1, wherein said at least one of the control variables indicative of the loaded condition of the engine is a position of a throttle valve or a pressure in an intake manifold.

4. A method as claimed in claim 1, wherein said variation of the control variable computed after the predetermined period from the time of previous computation is modified by at least one of the variables indicative of the condition of the operating environment of the engine.

5. A control method as claimed in claim 4, wherein said at least one of the variables indicative of the condition of the operating environment of the engine is a temperature of engine cooling water, temperature of intake air or atmospheric pressure.

6. A apparatus for electronically controlling the amount of fuel supplied to an internal combustion engine comprising:

means for sensing at least one of the control variables indicative of the loaded condition of the engine at predetermined time intervals to detect a variation thereof from the previous time to the present time;

means for determining whether said engine is in an accelerating condition or deceleration condition by judging the sign of said variation;

means for adding the previous value of a fuel supply amount correction factor for acceleration computed at the time of previous computation to the detected variation only when the engine is judged in the preceding step as being in the accelerating condition thereby computing the sum;

means for substracting a predetermined substraction constant from the sum obtained as a result of the addition by said second means to compute a difference therebetween, thereby obtaining a new value of the fuel supply amount correction factor; and means using the thus obtained new value of the fuel supply amount correction factor to correct a basic fuel supply amount computed separately on the basis of the operating condition of the engine; and means for supplying fuel to said engine, the amount of the fuel corresponding to the corrected basic fuel supply amount.

7. An apparatus as claimed in claim 6, further comprising:

means for clearing the content of said fuel supply amount correction factor for acceleration when the engine is judged by said determining means as being not in the accelerating condition.

8. A method for controlling the fuel injection having a fuel injector, said method comprising the steps of:

(a) producing a value of change of throttle position at a predetermined interval of time;

(b) determining whether said engine is in an accelerating condition or a decelerating condition by judging the sign of said value of change;

(c) when said engine is determined to be in the accelerating condition, comparing said value of throttle position change with a first constant predetermined depending on the type of said engine and determining whether said value of change is larger than said first constant or not, when said value of change is larger than said first constant, a fuel injection amount correction factor in the decelerating condition and calculated at the previous time is updated to zero;

(d) when said engine is determined in the step (b) to be in the decelerating condition, comparing said value of throttle position change with a second constant predetermined depending on the type of said engine and determining whether said value of change is larger than said second constant or not, when said value of change is larger than said second constant, a fuel injection amount correction factor in the accelerating condition and calculated at the previous time is updated to zero, (e) calculating a corrected value of throttle position change by multiplying said value of change by at least one of a cooling water temperature-dependent correction coefficient $f$(THW), an intake air temperature-dependent correction coefficient $f$(THA) and an atmospheric pressure-dependent correction coefficient $f$(Pa);

(f) modifying the fuel injection amount correction factor previously calculated or updated to zero by adding thereto said corrected value of throttle position change to obtain the modified correction factor, wherein when said value of throttle position change has been determimed to be larger than said first constant in the accelerating condition in the step (c) or in the previous time, said corrected value of throttle position change is added to said fuel injection amount correction factor in the accelerating condition calculated in the previous time or updated to zero in the step (d), and when said value of throttle position change has been determined to be larger than said second constant in the decelerating condition in the step (d) or in the previous time, said corrected value of throttle position change is added to said fuel injection amount correction factor in the decelerating condition calculated in the previous time or updated to zero in the step (c);

(g) calculating a further modified fuel injection amount correction factor by subtracting a subtraction constant predetermined depending on the performance characteristics of said engine from said modified fuel injection amount correction factor;

(h) correcting a basic fuel injection amount calculated on the basis of an engine speed and an intake manifold pressure by said further modified fuel injection amount correction factor either to increase or decrease the amount of fuel injection depending on whether said engine is in the accelerating condition or the decelerating condition; and generating a fuel injection control pulse signal having a pulse width corresponding to the corrected basic fuel injection amount and controlling said fuel injector in accordance with said fuel injection control pulse signal.

* * * * *